US005787809A

United States Patent [19]

Bosse

[11] Patent Number: 5,787,809

[45] Date of Patent: Aug. 4, 1998

[54] PRINTED WEB SMOOTHING DEVICE AND METHOD

[75] Inventor: Rolf Bosse, Grasbrunn, Germany

[73] Assignee: Eltex-Elektrostatik GmbH, Weil am Rhein, Germany

[21] Appl. No.: 652,499

[22] PCT Filed: Dec. 6, 1994

[86] PCT No.: PCT/EP94/04062

§ 371 Date: Jun. 3, 1996

§ 102(e) Date: Jun. 3, 1996

[87] PCT Pub. No.: WO95/15854

PCT Pub. Date: Jun. 15, 1995

[30] Foreign Application Priority Data

Dec. 11, 1993 [DE] Germany ..... 43 42 308.6

[51] Int. Cl.[6] ..... B41F 3/52; B41F 23/04

[52] U.S. Cl. ..... 101/226; 101/488

[58] Field of Search ..... 400/613.3; 101/220, 101/487, 488, 226

[56] References Cited

U.S. PATENT DOCUMENTS

| | | | |
|---|---|---|---|
| 2,329,152 | 9/1943 | Breyer | 101/488 |
| 3,273,498 | 9/1966 | Martin | 101/488 |
| 4,417,516 | 11/1983 | Fischer | 101/228 |
| 4,774,771 | 10/1988 | Littleton | 101/487 |
| 5,163,369 | 11/1992 | Hawitt | 101/425 |
| 5,188,028 | 2/1993 | Reichel | 101/228 |
| 5,275,103 | 1/1994 | Hahne | 101/487 |
| 5,410,392 | 4/1995 | Landa | 355/271 |
| 5,547,225 | 8/1996 | DeAngelis | 101/487 |
| 5,606,914 | 3/1997 | Borgardt | 101/216 |

*Primary Examiner*—Edgar S. Burr
*Assistant Examiner*—Daniel J. Colilla
*Attorney, Agent, or Firm*—Antonelli, Terry, Stout & Kraus, LLP

[57] ABSTRACT

The invention relates to a process and apparatus for the production of printed pages from a web that is moved continuously in the transport direction in rotary offset printing and printed on one or both sides, is heat set and then, by being transferred to at least a first cooling roller, is cooled in a first curvature direction with a first curvature radius, the web then being separated into the printed pages optionally after folding. The web is inverted, before being transferred to at least the first cooling roller, with a second curvature radius to obtain smooth, unrippled pages.

30 Claims, 4 Drawing Sheets

PRINTED WEB SMOOTHING DEVICE AND METHOD

BACKGROUND OF THE INVENTION

The invention relates to a device as well as a method for producing printed sheets, e.g., a device for producing printed sheets from a web in a web-fed offset press.

It is known that, in web-fed offset printing, the web, printed on its front and back, is heated to approximately 120° C. to dry the ink. Then the web is cooled, moistened, possibly folded, and separated from the web as sheets.

The waves that occur in the finished product, the individual sheets, are disadvantageous in these known devices and methods. This wave formation has been the frequent subject of studies; despite all efforts, the waves that occur in web-fed offset printing have thus far not been eliminated, but their amplitude has been reduced (see FOGRA, Report 4.035, 1989). This procedure which reduces the amplitude takes its departure from the idea that as a result of the escape of water during drying of the web, combined with tension on the web, a waviness forms, so that attempts have been made to eliminate these so-called climate or tension waves by subsequently re-moistening the dried and cooled web. These attempts have had only moderate success, however.

SUMMARY OF THE INVENTION

The goal of the invention is to improve on a device for producing printed sheets from a web in a web-fed offset press, as well as a method, in such fashion that smooth, unwavy sheets can be obtained.

According to the invention, the printed web, immediately before running onto the first cooling roller, is deflected at least once by means of a web expander, once or several times in opposite directions of curvature, preferably by nozzle boxes.

Thus, deflection can be caused by a stream of compressed air. The deflection can be performed after hot drying, and, additionally, the web can be precooled before running onto at least a first cooling roller.

Surprisingly, it has been found that by virtue of this simple measure, wave formation in the sheets is practically completely eliminated and, in contrast to the prior art, smooth, unwavy sheets are obtained for the first time. The mechanism on which this striking effect is based is not known at the present time. Perhaps it consists in the fact that as a result of the (at least single) deflection, forced relaxation and flattening of the web occurs prior to its running onto the first cooling roller, so that as the web runs onto the first cooling roller, no waves can form to then be impressed by wrapping around the cooling roller or rollers because of the different radius of curvature of the wave against the roller, with the web also being stabilized by the cooling effect on the printing coating. This problem is solved in a surprisingly simple fashion by the teaching according to the invention.

A device is known (DE3128430 C2, FIG. 3) in which the web, before running onto the (at least first) cooling roller with its first radius of curvature and its first curvature direction, is deflected by a second radius of curvature in a second curvature direction opposite the first. Apart from the fact that this deflection is not performed immediately before the web runs onto the first cooling roller but only at a considerable distance before that point, this measure serves as a path compensation device for the web by virtue of the adjustability of the calender rolls of the cooling mechanism. Thus this path compensation device can be located before or after the cooling mechanism and plays no role in the arrangement of the direction of curvature of the deflection before the first cooling roller, and is purely arbitrary. A device is also known (JP2-59348 (A) in Patent Abstracts of Japan, M-974, May 16, 1990, Volume 141, No. 231), in which deflection occurs ahead of the first cooling roller as described above. Here however there is no direct arrangement of the web before it runs onto the first cooling roller, and the available second radius of curvature is so small that the effect according to the invention cannot be achieved, and in addition this device serves to strip a laminar layer of solvent transported by the web on a conveying structure and also to remove dust and the like by means of air blown against the transport direction, quite apart from the fact that for this known purpose, the arrangement of the curvature directions could also be reversed and therefore can be considered arbitrary as well.

DETAILED DESCRIPTION OF THE INVENTION

Figure 1:
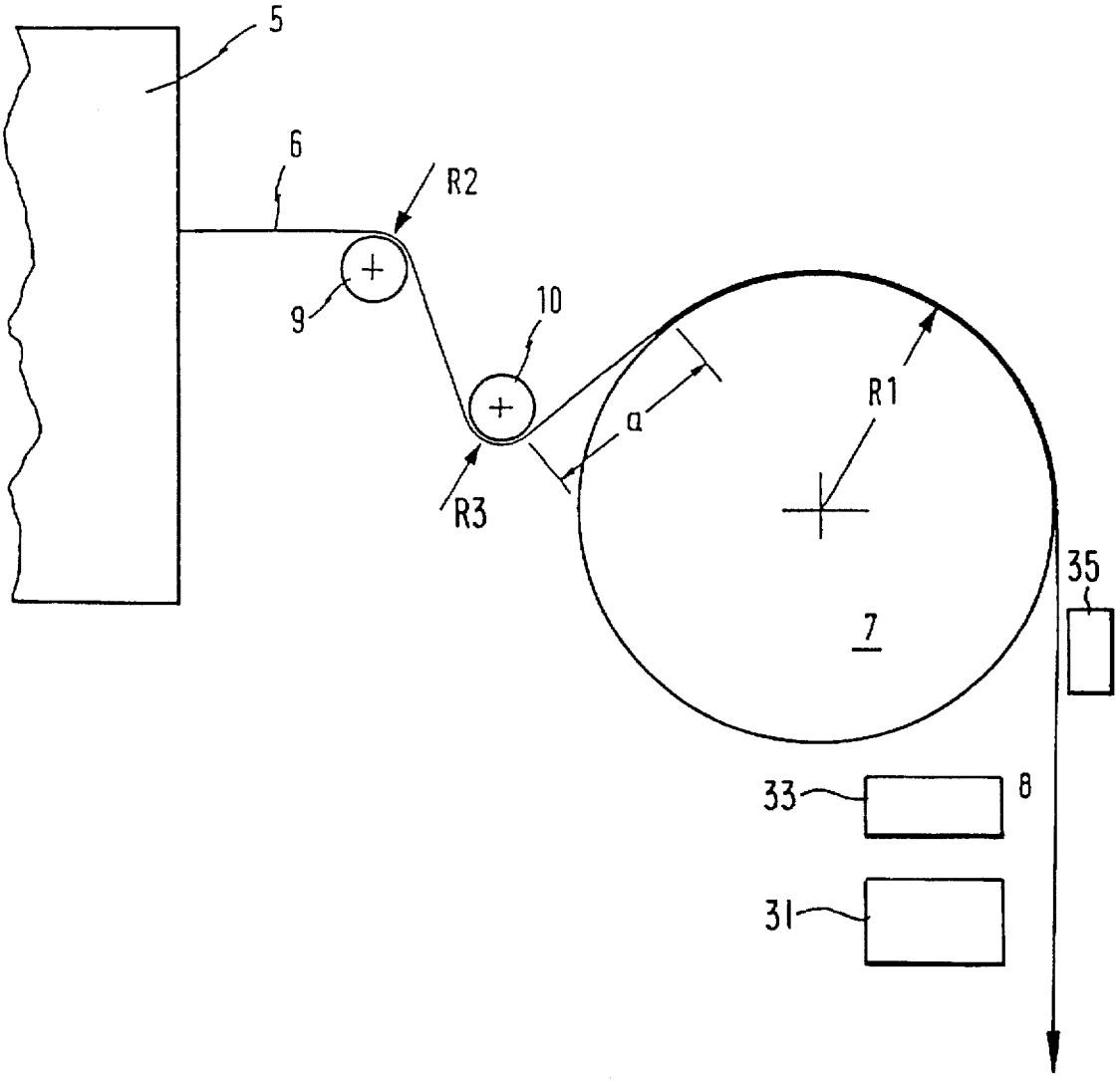
FIG. 1 shows a schematic cross section through a web-fed offset press in the area between the dryer and the first cooling roller as a first embodiment of the present invention.

One embodiment of the invention will now be described in greater detail with reference to FIG. 1, showing a schematic cross section through a web-fed offset press in the area between the dryer and the first cooling roller.

Web 6, preferably a paper web, runs out of the dryer, designated as a whole by 5, said web being printed on both sides, in the direction of the first cooling roller, designated as a whole by 7, on which web 6 runs clockwise with a first radius of curvature R1 and a first curvature direction.

Before web 6 runs onto first cooling roller 7 in transport direction 8, it is deflected twice in the embodiment shown, each time with the same second and third radius of curvature R2 and R3, in respectively opposite directions at a first deflection point 9 and a second deflection point 10 located beyond in the direction of transport. At the second deflection point immediately before the web runs onto cooling roller 7, the second curvature direction is counterclockwise, and therefore opposite the first curvature direction of cooling roller 7. At first deflection point 9, web 6 is deflected in the first curvature direction. Means for folding the pages (means for folding 33) and means for separating 31 the pages from the web respectively are provided in sequence in the transport direction, downstream from the cooling roller 7.

Figure 4:
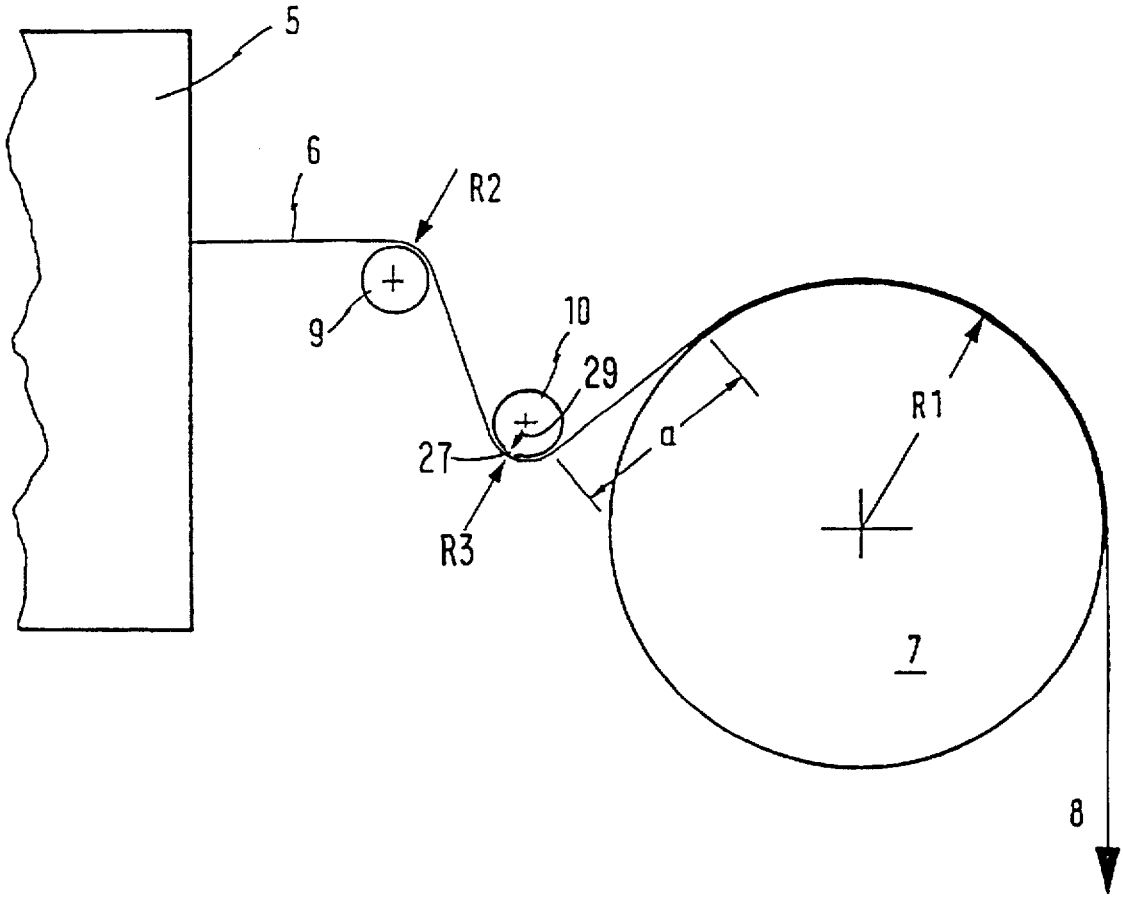
FIG. 4 shows a schematic cross section through a web fed offset press in the area between the dryer and the first cooling roller, of a fourth embodiment of the invention.

In one advantageous embodiment, shown schematically in FIG. 4, deflection points (inversion devices) 9 and 10 are each formed by a nozzle box known of itself, which has a perforation 27 on its jacket in the deflection area of the web through which air 29 supplied laterally and axially can escape radially. This forms an air cushion around which web 6 is deflected with zero contact with the nozzle box.

In the embodiment shown, second radius of curvature R2 is smaller than first radius of curvature R1 and the quotient of the first to the second radius of curvature is larger than 3, preferably 5 to 12, most preferably 10. For example, the second radius of curvature is not greater than 10 cm. In addition, second radius of curvature R2 of the web exists over a wrap angle of at least 30°, preferably 45°. The length a of the uncurved and flat web 6 before first cooling roller 7 is less than six times the second radius of curvature R2, preferably less than three times the second radius of curvature R2, and in the embodiment shown is about three times radius R2. For example, the length a is smaller than 30 cm.

Figure 2:
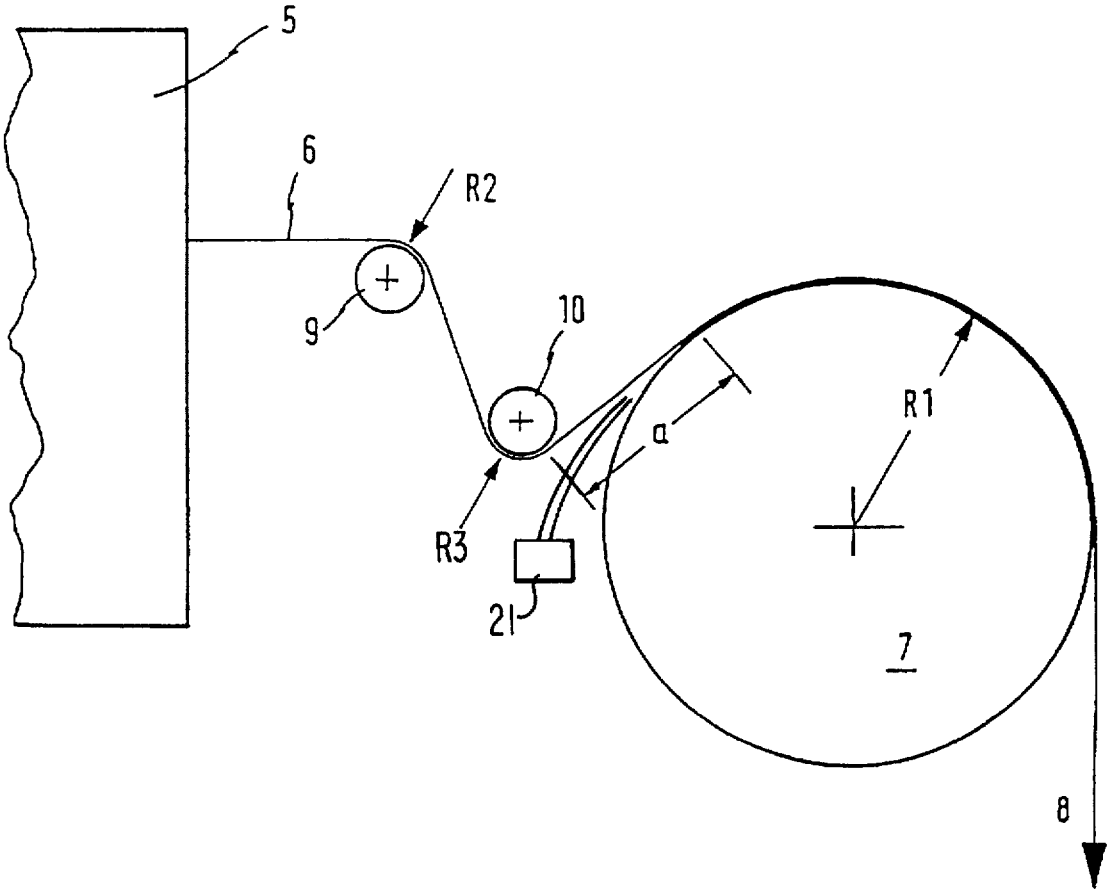
FIG. 2 shows a schematic cross section through a web fed offset press in the area between the dryer and the first cooling roller, of a second embodiment of the invention.
Figure 3:
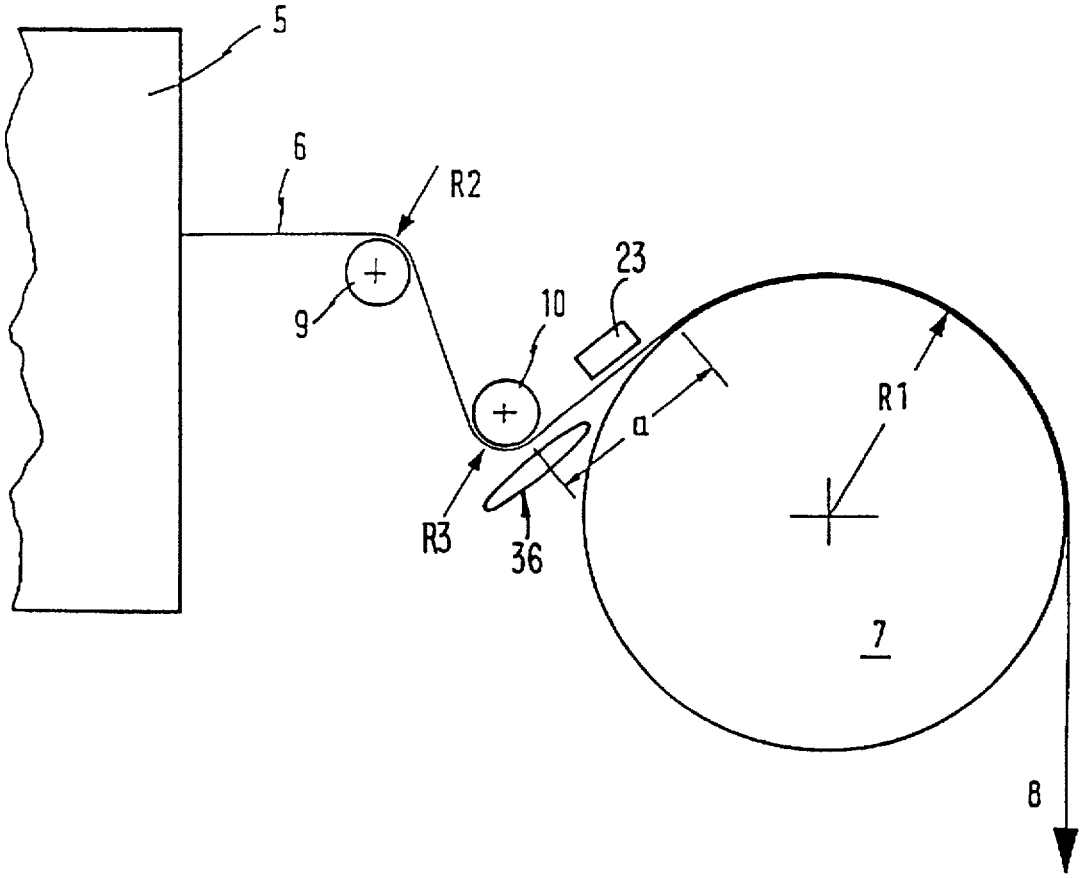
FIG. 3 shows a schematic cross section through a web fed offset press in the area between the dryer and the first cooling roller, of a third embodiment of the invention.

According to the invention, the printed web, immediately before running onto the first cooling roller, is deflected at least once by means of a web expander, once or several times in opposite directions of curvature, preferably by nozzle boxes. However, a Coanda plate 36 (FIG. 3) can also be located outside the web and extending parallel thereto, with air being blown by means of an additionally mounted air nozzle 21 (FIG. 2) into the gap between the nozzle and the web, causing the web to be drawn toward the Coanda plate but without touching it. The dimensioning and arrangement of these Coanda plates is advantageously performed successively on the top and bottom of the paper web. However, a plurality of small Coanda plates can be mounted on one side, said plates being located side by side or staggered in the direction of paper travel, said plates also being staggered slightly convexly or concavely in a lengthwise section parallel to the transport direction.

Thus, deflection can be caused by a stream of compressed air. The deflection can be performed after hot drying, and, additionally, the web can be precooled before running onto at least a first cooling roller.

Surprisingly, it has been found that by virtue of this simple measure, wave formation in the sheets is practically completely eliminated and, in contrast to the prior art, smooth, unwavy sheets are obtained for the first time. The mechanism on which this striking effect is based is not known at the present time. Perhaps it consists in the fact that as a result of the (at least single) deflection, forced relaxation and flattening of the web occurs prior to its running onto the first cooling roller, so that as the web runs onto the first cooling roller, no waves can form to then be impressed by wrapping around the cooling roller or rollers because of the different radius of curvature of the wave against the roller, with the web also being stabilized by the cooling effect on the printing coating. This problem is solved in a surprisingly simple fashion by the teaching according to the invention.

In an advantageous embodiment of the invention, precooling can be performed with cold air before cooling. It has also been found to be advantageous to produce a vacuum (e.g., provide a vacuum device 21, as in FIG. 2) in the vicinity of the In-feed nip between the web and the first cooling roller (ahead of the first cooling roller in the In-feed nip, in the transport direction). The effect achieved according to the invention is likewise favored if the web, on the side facing away from the surface of the first cooling roller, is electrostatically charged in the transport direction before it reaches the roller by means of a charge electrode (the charging electrode can be located transversely with respect to the transport direction beyond the first deflection point 10 and before running onto the first cooling roller 7, as shown by charging electrode 23 in FIG. 3). The cooling roller can be any of a cooling roller 7, such as a cooling roller with a coating, such as a nonadhesive coating or a cooling roller 7 wetted with a fluid, such as a fluid lubricant. This measure also contributes to the desired flattening of the web perpendicular to the transport direction, before or during its running onto the first cooling roller. Water can be applied as a fluid to the web on the side facing the first cooling roller, and/or onto the first cooling roller.

The process of the invention results in the production of printed pages from a web that is moved continuously by a conveying structure 35 in the transport direction in rotary offset printing and printed on one or both sides. In the process the printed pages are heat set and then, transferred to at least a first cooling roller, and cooled in a first curvature direction with a first curvature radius. The web is then separated by means for separating the web into the printed pages 31 optionally after folding on a folding device 33. The web is inverted, before being transferred to at least the first cooling roller, with a second curvature radius to obtain smooth, unrippled pages.

I claim:

1. A device for the production of printed pages from a web that is moved continuously in a transport direction, the web being printed on at least one side and being cut to form the printed pages, the device comprising:

a dryer for heat-setting the printed web; and a first cooling roller, provided downstream of the dryer in the transport direction, at which the printed web is cooled while passing in a first curvature direction, said first cooling roller having a first curvature radius;

and wherein the device further comprises two inversion devices located in sequence before the first cooling roller, and after the dryer, in the transport direction, the two inversion devices and the first cooling roller inverting a direction of curvature of the web three times, one of the two inversion devices being closer to the first cooling roller, in the transport direction, than the other inversion device is, said one of the two inversion devices having a second radius of curvature, the second radius of curvature being not greater than 10 cm, the one of the two inversion devices being located less than 30 cm from the first cooling roller.

2. Device according to claim 1, wherein said two inversion devices are selected from the group consisting of an air nozzle, a cooling roller provided with a nonadhesive coating, a roller wetted with a fluid lubricant, and a Coanda plate.

3. Device according to claim 2, wherein said two inversion devices include a Coanda plate, said Coanda plate having an air nozzle.

4. Device according to claim 1, further comprising a conveying structure for continuously moving the web through said dryer and past said two inversion devices and said first cooling roller, in said transport direction.

5. Device according to claim 4, further comprising means for separating said pages from the web, downstream of the first cooling roller in the transport direction, for cutting the web to form the printed pages.

6. Device according to claim 5, further comprising a folding device, upstream of the means for separating said pages from the web in the transport direction, for folding the web.

7. Device according to claim 1, wherein the direction of curvature of the web about said one of the two inversion devices is oriented in a direction opposite a direction of curvature of the web about the other of the two inversion devices.

8. Device according to claim 1, wherein means for forming a vacuum is provided, in the transport direction, upstream of said first cooling roller in an entry gap between said web and said first cooling roller.

9. Device according to claim 1, wherein , on a side of the web facing away from said first cooling roller, upstream of the first cooling roller in the transport direction, an electrostatic charging electrode is provided.

10. Device according to claim 9, wherein the charging electrode is placed, in the transport direction, downstream of an inversion point of the inversion device and upstream of a transfer to the first cooling roller, crosswise to the transport direction.

11. Device according to claim 1, wherein the first cooling roller has a coating that does not adhere to the printed web.

12. Device according to claim 1, wherein the second radius of curvature is smaller than the first curvature radius.

13. Device according to claim 12, wherein a ratio of the first curvature radius to the second radius of curvature is greater than 3.

14. Device according to claim 12, wherein said ratio is in a range of 5 to 12.

15. Device according to claim 12, wherein said ratio is 10.

16. Device according to claim 1, wherein the web is transported such that it follows the second radius of curvature, adjacent the one of the inversion devices, over a belt wrap angle of at least 30°.

17. Device according to claim 16, wherein the web is transported such that it follows the second radius of curvature, adjacent the one of the inversion devices, over a belt wrap angle of at least 45°.

18. Device according to claim 1, wherein the web is transported such that a length (a) of uncurved and flatly running web between the one of the inversion devices and the first cooling roller is smaller than six times the second radius of curvature.

19. Device according to claim 18, wherein said length (a) is less than three times the second radius of curvature.

20. Process for production of printed pages from a web that is moved continuously in a transport direction, the web being printed on at least one side and being separated to form the printed pages, the process comprising the steps of:

heat-setting the web; and transferring the web to a first cooling roller, at which the web is cooled while being transferred in a first curvature direction with a first curvature radius, wherein the process further comprises the steps, after the heat-setting and before the web is cooled at the first cooling roller, of inverting the web twice respectively with two inversion devices, one of the two inversion devices being closer to the first cooling roller than the other inversion device is, said one of the two inversion devices having a second radius of curvature, the second radius of curvature being not greater than 10 cm, and a distance between said one of the two inversion devices and the first cooling roller is less than 30 cm.

21. Process according to claim 20, including the further step of separating the pages from the web after transferring the web to the first cooling roller, to form the printed pages.

22. Process according to claim 21, including the further step of folding the web before the step of separating the pages from the web.

23. Process according to claim 20, wherein the web is inverted with a direction of curvature of one of the two inversion devices that is opposite the direction of curvature of the web about the other of the two inversion devices.

24. Process according to claim 20, wherein the inverting is performed by blowing air.

25. Process according to claim 20, wherein the web, which has been inverted twice after the heat-setting and before being cooled on the first cooling roller, is additionally precooled before being transferred to the first cooling roller.

26. Process according to claim 25, wherein the web is precooled with cold air.

27. Process according to claim 25, wherein after the heat setting and before the transfer to the first cooling roller, the process further comprises generating a partial vacuum in an entry gap between the web and the first cooling roller.

28. Process according to claim 20, wherein the web is subjected to an electrical field in the transport direction before being transferred to the first cooling roller.

29. Process according to claim 28, wherein the web is electrostatically charged, after a last inversion and before being transferred to the first cooling roller, on its side facing away from the surface of the first cooling roller.

30. Process according to claim 20, wherein the web is flattened, during transfer to the first cooling roller, perpendicular to the plane of the web in the transport direction.

* * * * *